United States Patent [19]

Warner

[11] Patent Number: 5,022,443

[45] Date of Patent: Jun. 11, 1991

[54] MEASURING FLASK CONSTRUCTION FOR USE IN A FILLING MACHINE

[75] Inventor: Graeme W. Warner, Hinsdale, Ill.

[73] Assignee: John R. Nalbach Engineering Co., Inc., Cicero, Ill.

[21] Appl. No.: 488,623

[22] Filed: Mar. 5, 1990

Related U.S. Application Data

[63] Continuation-in-part of Ser. No. 322,417, Mar. 10, 1989, Pat. No. 4,915,146, which is a continuation-in-part of Ser. No. 167,389, Mar. 14, 1988, abandoned.

[51] Int. Cl.[5] ..... B65B 1/22

[52] U.S. Cl. ..... 141/129; 141/144; 141/148; 141/374

[58] Field of Search ..... 141/144–152, 141/163, 177, 181, 182, 250, 251, 263, 374, 392, 331, 332, 339, 340

[56] References Cited

U.S. PATENT DOCUMENTS

| | | | |
|---|---|---|---|
| 1,881,106 | 10/1932 | Vogt et al. | 141/263 |
| 3,068,911 | 12/1962 | Hoyer | 141/182 |
| 3,554,412 | 1/1971 | Hayashi et al. | 141/144 X |
| 3,951,186 | 4/1976 | Mencacci | 141/5 |
| 3,967,659 | 7/1976 | Warner et al. | 141/374 |
| 3,967,662 | 7/1976 | Warner | 141/148 |
| 3,978,900 | 9/1976 | Mencacci et al. | 141/374 |
| 4,122,876 | 10/1978 | Nalbach | 141/177 |
| 4,130,147 | 12/1978 | Langlie et al. | 141/98 |
| 4,230,002 | 10/1980 | Skidmore | 141/331 X |
| 4,915,146 | 4/1990 | Warner | 141/144 |

FOREIGN PATENT DOCUMENTS

| | | | |
|---|---|---|---|
| 689889 | 10/1979 | U.S.S.R. | 141/182 |
| 24465 | 11/1908 | United Kingdom | 141/339 |

*Primary Examiner*—Ernest G. Cusick
*Attorney, Agent, or Firm*—Anthony S. Zummer

[57] ABSTRACT

An improved measuring flask is used in a filling machine for filling identical containers with the same measured amount of divided matter. The filling machine includes a filling turret having a rotatable portion driven by a drive. The filling turret includes a filling tank having a rotatable floor connected to the drive. The rotatable floor rotates with the rotating portion of the filling turret. A plurality of measuring flasks is arranged in a circle concentric with the circle of rotation of the rotating portion of the filling turret. Each of the measuring flasks is connected to the rotatable floor of the filling tank for receiving divided matter from the filling tank and measuring the amount of the matter. Each of the measuring flasks includes a transition body having one end connected to the rotatable floor and an opposite end extending downward. An open ended tube has one end connected to the opposite end of the transition body and the other end of the tube extends downward. The tube has a cylindrical interior surface. The transition body has a funnel-like transition interior surface. The transition interior surface is a surface of revolution. The transition interior surface has a reduced portion adjacent to the tube aligned with the upper end of the cylindrical interior surface. The remainder of the transition surface extends outward and upward from the reduced portion.

16 Claims, 3 Drawing Sheets

MEASURING FLASK CONSTRUCTION FOR USE IN A FILLING MACHINE

CROSS REFERENCE TO RELATED APPLICATION

The instant application is a continuation-in-part of patent application Ser. No. 322,417, filed Mar. 10, 1989, entitled, "Improved Measuring Flask For Use In A Filling Machine now U.S. Pat. No. 4,915,146 issued Apr. 10, 1990, which is a Continuation-In-Part of application Ser. No. 167,389, filed on Mar. 4, 1988, now abandoned.

BACKGROUND OF THE INVENTION

The use of automated machines for filling containers with flowable powdered or granular material is well known. These powdered or granular materials include a broad range of food products, including but not limited to; milk products, condiments, tea, coffee, sugar, cocoa, rice, seeds and the like; as well as a general line of chemicals, including but not limited to; cleaners, lyes, crystals, and the like. Machines of this general type have found a wide range of acceptance in a wide range of industries including; the food, chemical and cosmetic industries, for the purpose of packaging all manner of dry materials. A certain machine which has found wide acceptance in the aforementioned industries is disclosed in U.S. Pat. No. 3,967,662, entitled, "Container Filling Apparatus", which issued July 6, 1976, wherein Graeme Warner of Hinsdale, Illinois is the patentee. The operation of the patented machine has been widely accepted as being satisfactory; however, a problem may arise when the patented machine is used with certain powdered or granular materials and in particular, those materials which have poor flowability because of a high fat content or other properties of the material. Machines which have a construction such as that disclosed in U.S. Pat. No. 3,967,662, utilize measuring flasks which have a construction similar to the construction of the measuring flask shown in FIG. 4 of that patent. Typically, the flask includes a head which is connected to a thin wall tube which extends downward. The interior surface of the head has a generally conical interior surface having a taper between 5° and 15°. When a measuring flask is used with a powdered or granular material which has poor flowability, because the material has a high fat content or for other reasons, the material in some instances, may hang up in the head. Thus, all of the material in the flask is not delivered to a respective container.

It is desirable to provide a measuring flask construction wherein granular or powdered material having poor flowability will not hang up in the measuring flask. Thus, all of the material contained in the flask will be delivered to a container which is adapted for receiving and holding the subject material.

SUMMARY OF THE INVENTION

The present invention relates to an improved measuring flask construction which is particularly adapted for use in a filling machine for filling containers with a like measured amount of powdered or granular material and in particular material which has poor flowability because of a high fat content or other reasons.

The subject measuring flask is particularly adapted for use with a filling machine which generally includes a filling turret having a rotatable portion. A drive is connected to the rotatable portion. The filling turret includes a filling tank having a rotatable floor. A drive is connected to the rotatable floor for rotating with the rotating portion of the filling turret. A plurality of the instant improved measuring flasks is arranged in a circle concentric with the circle of rotation of the rotating portion of the filling turret. Each of the measuring flasks is particularly adapted for receiving divided matter from the filling tank and measuring the amount of matter received. Each of the measuring flasks includes a transition body having one end connected to the rotatable floor and an opposite end extending downward. An open ended tube has one end connected to said opposite end of the transition body and the other end of the tube extends downward. The tube has a cylindrical interior surface. The transition body has a funnel-like transition interior surface. The transition interior surface is a surface of revolution having a reduced portion adjacent to the tube aligned with the upper end of the tube cylindrical interior surface. The remainder of the transition interior surface extends outward and upward from the reduced portion to allow divided matter to pass through the transition portion without hanging up in the measuring flask.

DESCRIPTION OF THE PREFERRED EMBODIMENT

Figure 1:
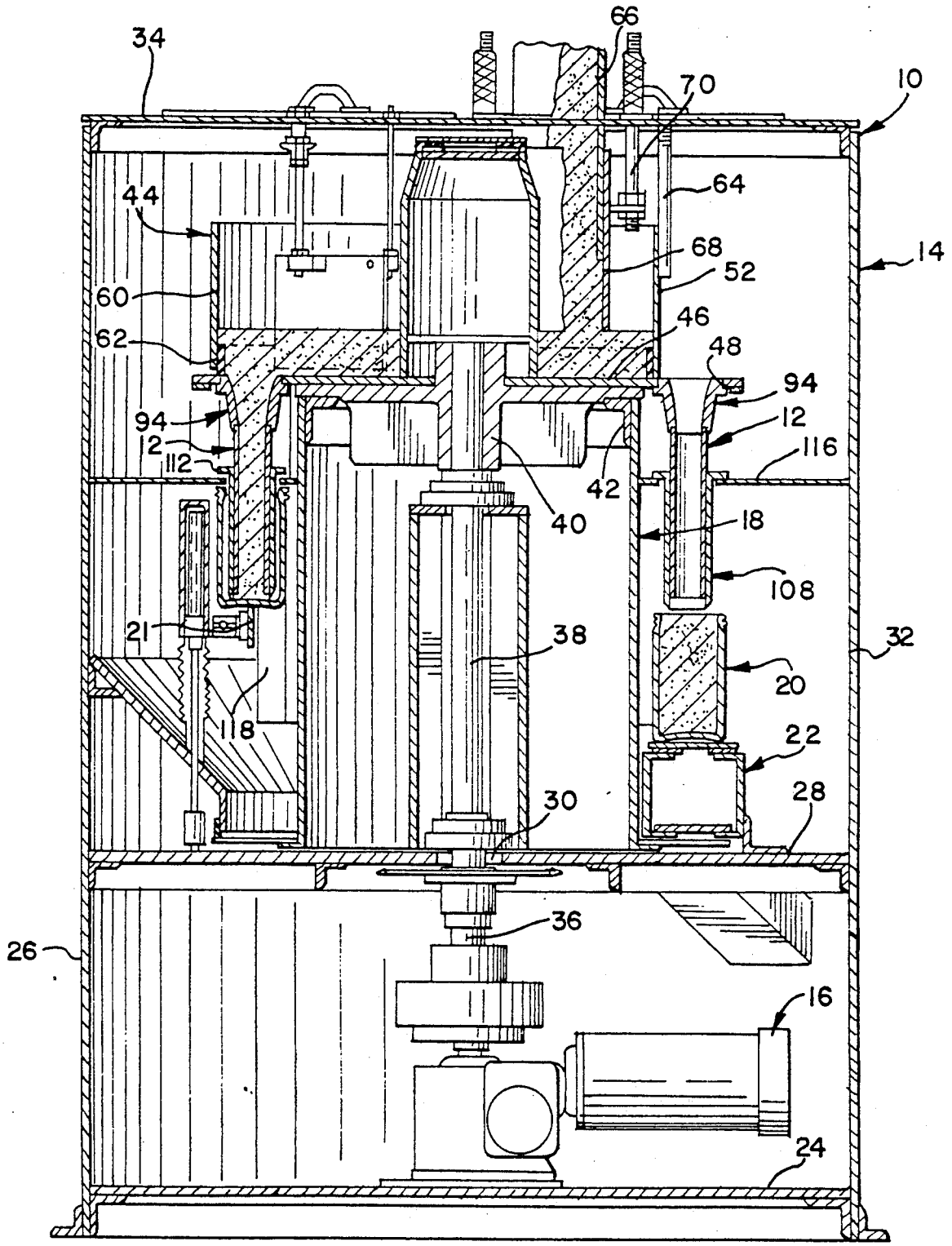
FIG. 1 is a cross sectional elevational view of a container filling machine including a plurality of measuring flasks embodying the herein disclosed invention.

Referring now to the drawings and especially to FIG. 1, a container filling machine 10, which is similar to the apparatus shown and described in detail in U.S. Pat. No. 3,967,662, is shown therein with improved measuring flasks 12 mounted in the machine. The herein disclosed filling machine is particularly adapted for filling containers with granular or powdered material, which material has poor flowability because it contains fat or has other properties which inhibit free flow. The present construction of the filling machine is such that the material does not hang up in the flasks but rather flows smoothly through the flasks. Machine 10 generally includes a housing 14 with a conventional variable drive 116 mounted in the lower portion of the housing. A filling turret 18 is mounted in the housing. An input conveyor which is conventional for this type of machine and is not shown herein delivers empty containers 20 to filling turret 18. Containers 20 are conventional and may be made of any suitable material including;

glass, plastic or metal. The containers are delivered to a conventional and well known container elevator which is not shown herein. Then, the containers are carried by the container elevator to a conventional arcuate container support 21 on which the containers are lowered to effect filling of the containers. An output conveyor 22 is positioned adjacent to the filling turret for receipt of filled containers from the arcuate container support to carry away the filled containers.

Housing 14 generally includes a drive floor 24 which supports drive 16. A skirt 26 has its lower edge connected to drive floor 24 to enclose drive 16. A filler floor 28 is mounted on the upper portion of the skirt. The filler floor includes a drive aperture 30 in the center thereof for receiving a portion of drive 16. A filler wall 32 is connected to the skirt. The housing is substantially completed by a roof 34 secured to the top portion of the filler wall. Roof 34 has an inlet aperture to provide an opening for delivery of divided matter into the housing.

Figure 2:
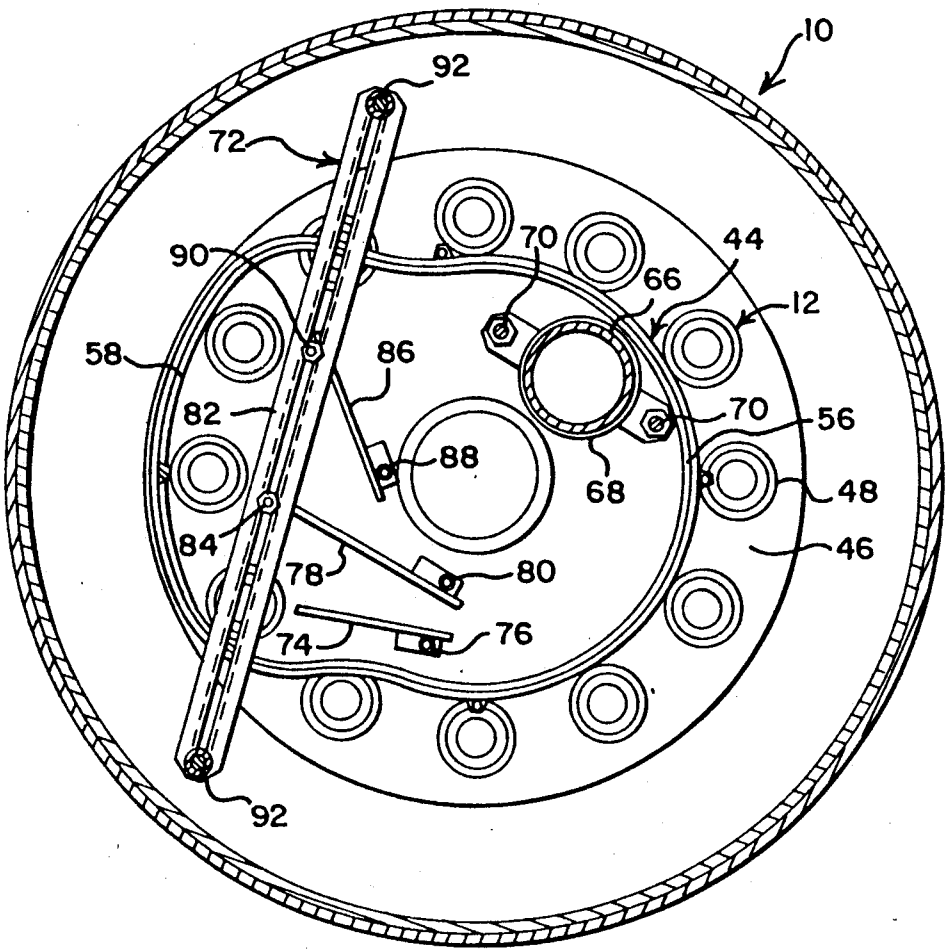
FIG. 2 is a top view of the filling machine of FIG. 1.

Drive 16 is a conventional and well known electric motor speed reducer combination having an output shaft 36 extending therefrom through aperture 30. Filling turret 18 includes a drive shaft 38 which is connected to shaft 36. Drive shaft 38 is drivingly connected to a hub 40 which has a drum 42 mounted on its outer periphery. A filling tank assembly 44 is mounted on the upper portion of hub 40. Filling tank assembly 44 includes a rotatable tank floor 46 with a plurality of flask apertures 48 contained therein. Floor 46 is fixed to hub 40 to rotate with drum 42. Flask apertures 48 are arranged in a circle concentric with the axis of rotation of floor 46. The filling tank assembly includes a retainer 52 which has its lower edge positioned in sliding engagement with floor 46. The retainer includes a central loop 56 and a filling loop 58 as viewed in FIG. 2. Retainer 52 generally consists of two parts, namely, a sheet metal upper wall 60 and a resilient rubberlike scraper blade 62 connected to the lower edge of sheet metal upper wall 60. The scraper blade is in close scraping engagement with floor 46 to retain divided matter within the retainer. Retainer 52 is suspended from roof 34 by a plurality of wall supports 64 so that the retainer is held relative to the housing while floor 46 rotates relative to the same housing.

An inlet: tube 66 is positioned in the inlet aperture in the roof, and the tube terminates below the upper edge of retainer 52 as may be best seen in FIG. 1. The upper end of inlet tube 66 is connected to a source of divided matter which source is not shown herein but is conventional in the art. A telescoping inlet sleeve 68 is movably mounted on inlet tube 66. The inlet sleeve 68 is connected to a plurality of sleeve adjustment rods 70 which rods are mounted in roof 34 to regulate the height of the bottom of sleeve 68 relative to floor 46 and thereby regulate the depth of material held within the retainer.

The filling tank assembly also includes a product guide assembly 72 mounted within the housing. The product guide assembly includes an outer vane 74 which is supported from roof 36 by a conventional rod 76. An adjustable center vane 78 is supported from the roof by rod 80 at one end. The other end of valve 78 is connected to an adjustment rod 82 by a conventional fastener assembly 84 which allows the vane to be swung to a selected position for moving material in the filling tank. An inner vane 86 has one end pivotally connected to the roof through vane rod 88. The other end of vane 86 is connected to adjustment bar 82 by a conventional fastener assembly 90. The adjustment bar 82 is fixed to the roof by fasteners 92.

One of the improved measuring flasks 12 is mounted in each of the flask apertures 48 so that the flasks are located in a circle concentric with the axis of rotation of floor 46. Each of the measuring flasks is identical to each other measuring flask and includes, a transition body 94 and a stainless steel open ended right circular cylindrical thin walled tube 96 fixed to the transition body. Though the preferred material for tube 96 is stainless steel, any other suitable material may be used. Each tube 96 has a smooth cylindrical interior surface as well as a smooth cylindrical exterior surface.

Figure 3:
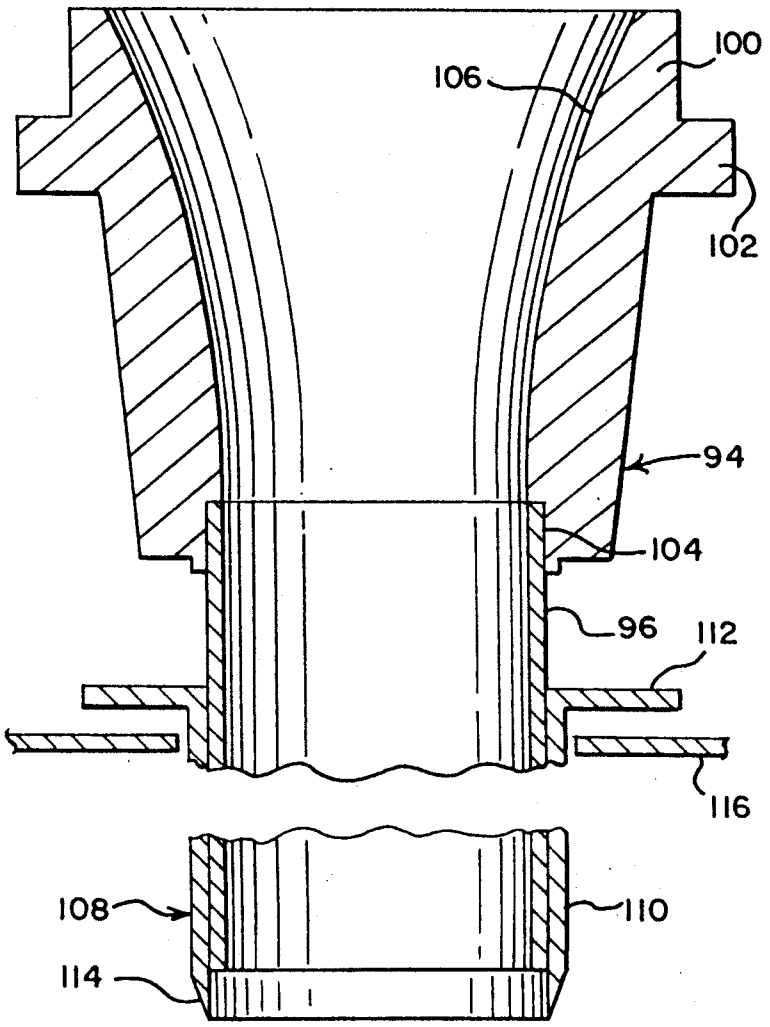
FIG. 3 is an enlarged cross sectional view of an improved measuring flask with parts broken away showing a transition body and a tube connected to the transition body but with the tube being broken away to show better the construction of the flask.

Each transition body includes a stanchion 100 which mates with its respective flask aperture 48. A mounting ring 102 is formed integral with stanchion 100 to position the transition body so that the upper end of the body is flush with floor 46. The body includes a mounting recess 104 in its lower end with tube 96 fixed in the recess by conventional means. The transition body has a funnel-like transition interior surface 106. The transition interior surface is a surface of revolution. The optimum surface of revolution for the transition interior surface is a portion of an elliptic hyperboloid of one sheet. The equipment necessary for making a transition interior surface which is a true portion of an elliptic hyperboloid of one sheet is not readily available. It has been found that an approximation of such a surface for the measuring flask of FIG. 3 is a surface of revolution of a line which includes an arc of a circle. The circle has its center positioned in a plane at the end of tube 96 perpendicular to the length of the tube. The transition interior surface has a reduced portion adjacent to the upper end of the tube. The reduced portion is aligned with the interior surface of the tube so that the reduced portion of the transition interior surface is tangent to an extension of the interior surface of the tube to allow a free flow of divided matter to flow from the transition body into the tube.

A sleeve 108 includes an open ended tubular body 110 which slidably receives tube 96. The construction and operation of sleeve 108 is shown and disclosed in detail in patent application Ser. No. 322,417, filed Mar. 10, 1989, entitled, "Improved Measuring Flask For Use In A Filling Machine", which disclosure is incorporated herein by reference. Sleeve 108 is made of a high impact strength plastic material, in this instance, polyurethane; however, the sleeve may be made of any suitable material including metal in certain applications. A retainer collar 112 is formed integral with one end of tubular body 110. A beveled end 114 is formed integral with the other end of the sleeve tubular body. A sleeve retainer shelf 116 is mounted within the housing and is engageable with collar 112 of the sleeve to provide a means for retaining the sleeve relative to tube 96 in one direction, but the shelf allows the sleeve to move freely relative to the tube until the sleeve engages the shelf or the sleeve engages a container.

The filling turret includes a plurality of conventional container pockets 118, each of which pockets is positioned adjacent to a respective measuring flask. Each of the pockets has walls which are mounted on drum 42 so that a container 20 positioned in one of the pockets is carried along with the drum and is raised and lowered relative to its flask as the container moves along the container support.

Containers 20 are delivered to the filling turret. Each of said pockets receives a container and the container is aligned with its respective measuring flask. Each container is raised relative to its respective measuring flask. While the container is being raised, a purging gas , such as, nitrogen, is introduced into the container. The container is raised to a position wherein the interior of the bottom of the container engages bevel edge 114 of the sleeve and pushes the sleeve upward relative to tube 96 displacing collar 112 from support 116. Free movement of sleeve 108 relative to tube 96 allows the sleeve to be positioned accurately and quickly to allow the filling machine to operate at a high rate of filling. The engagement of edge 114 with the bottom of the container creates a seal therebetween to prevent flushing of divided matter. The funnel-like transition interior surface enters the area of the filling tank where divided matter contained in the tank falls into the measuring flask. The measuring flask is carried along through the filling tank until it reaches the end of retainer 52 and there is no material to enter the measuring flask. The container then moves along its arcuate container support and drops down from its measuring flask. As the container drops away from sleeve 108, the material contained in the transition body, the tube and the sleeve flows into the container. By use of the present form of the funnel-like transition interior surface wherein the smaller end of the reduced portion of the transition interior surface is aligned with the interior surface of the tube and is tangent to an extension of the tube's interior surface, the material does not hang up in the measuring flask but rather there is a free flow of divided matter through the measuring flask and into the container. In the prior art devices such as the measuring flask construction shown in FIG. 4 of U.S. Pat. No. 3,967,662, the funnel-like transition interior surface is conical and there is no tangential mating of the transition interior surface to the interior surface of the tube. Thus, when certain divided materials are used, which divided materials have poor flowability because of a high fat content or for other reasons, in some instances, there is no free flow of that material out of the measuring flask as is desired.

When the collar of the sleeve engages support 116, the sleeve is held at one level. As the container drops away from the sleeve and the tube, all of the divided matter contained in the tube and sleeve is delivered to container 20. The container then drops away from the tube and sleeve after all of the divided matter has been allowed to leave the measuring flask. The filled container is then delivered to output conveyor 22 and is carried away from the filling machine for capping or other operations.

It is desirable in certain instances to provide a measuring flask which will deliver a selected volume of material to a container which has a small mouth relative to the total volume of the container. The container's small mouth requires that the diameter of the tube of the measuring flask be smaller. It follows that a measuring flask having a construction, such as, flask 12 described above may not have sufficient capacity to hold the required amount o divided matter.

Figure 5:
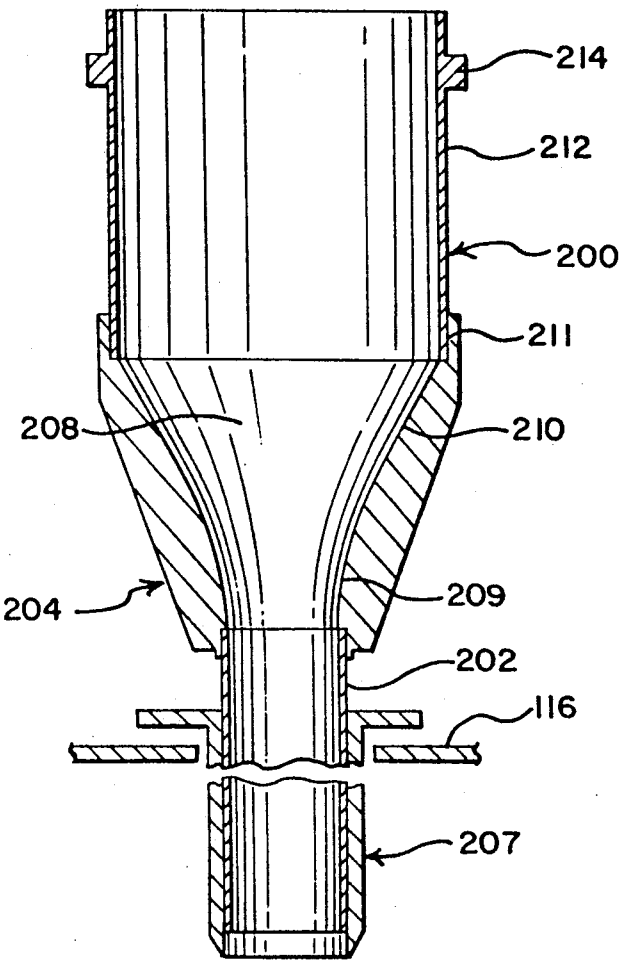
FIG. 5 is an enlarged cross sectional view of the measuring flask of FIG. 4 but with portions broken away in order to show better the construction of the measuring flask having the bin.
Figure 4:
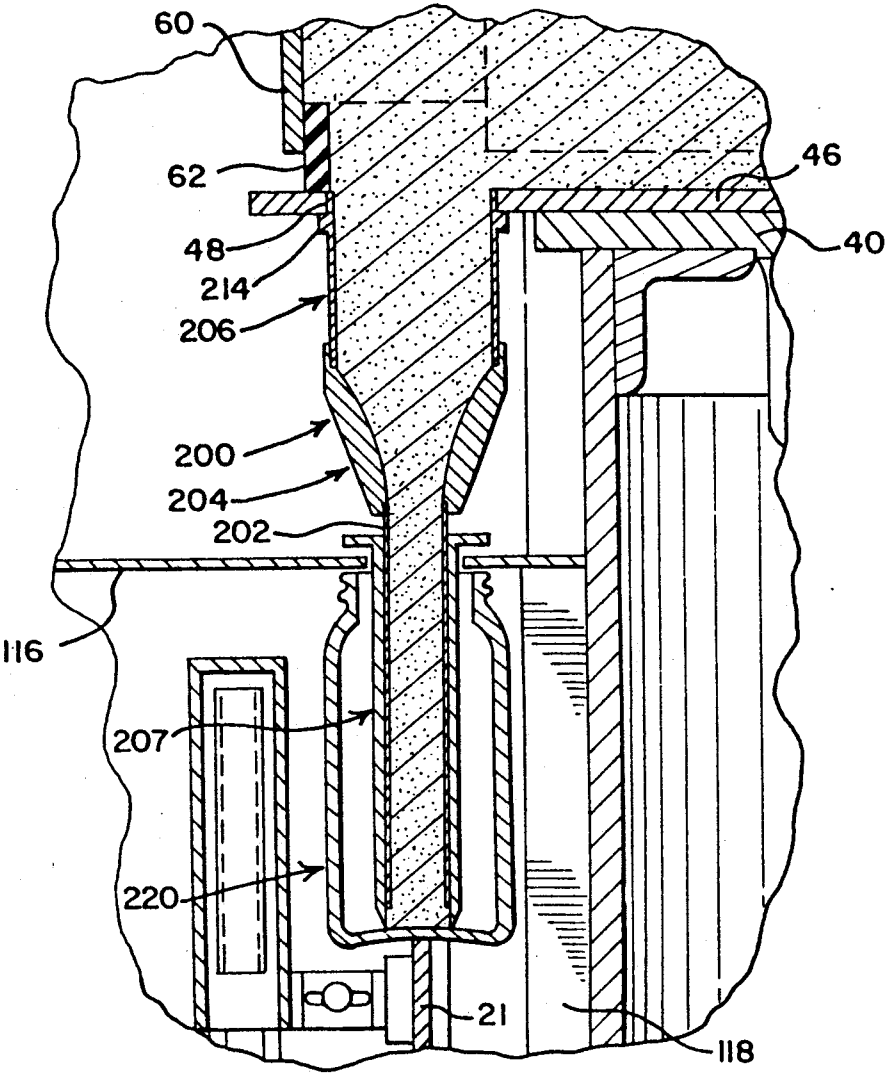
FIG. 4 is a fragmentary cross sectional view of a measuring flask for use in a filling machine such as that shown in FIG. 1 wherein the measuring flask includes a tubular bin for holding additional divided material and the measuring flask is shown mounted in a portion of the filling machine.

A modified form of measuring flask having a small tube relative to the total capacity for measuring divided matter is shown in FIGS. 4 and 5 and is identified by numeral 200. Measuring flask 200 includes four basic parts, namely; a right circular cylindrical tube 202, which is similar to tube 96, a transition body 204, which is secured to the upper end of tube 202, a tubular bin 206 connected to the upper end of transition body 204, and a sleeve 207 freely slidably mounted on tube 202.

Tube 202 is a right circular cylindrical thin walled open ended tube having a smooth right circular cylindrical interior surface. The exterior surface of tube 202 is a smooth right circular cylindrical surface. In this instance, tube 202 is made of stainless steel, but any other suitable material may be used.

Transition body 204 includes a funnel-like transition interior surface 208. The desired transition interior surface is a surface of a revolution which is a portion of an elliptic hyperboloid of one sheet. A transition interior surface wherein the line which generated the surface of revolution includes an arc of a circle and a straight line tangent to the arc of the circle provides a transition interior surface which operates successful. Transition interior surface 208 is a surface of revolution wherein the line which generates the surface is an arc of a circle and a straight line tangent to the arc. The circle has its center on a plane at the end of tube 202 and perpendicular to the length of the tube. The surface of revolution generated by the arc of the circle is identified by numeral 209. Surface 209 has a reduced portion having its smaller end aligned with the interior surface of tube 202. Surface 209 is tangent to an extension of the interior surface of tube 202. The surface of revolution generated by the straight line tangent to the arc of the circle is identified by numeral 210. Surface 210 extends upward and outward from the reduced portion to provide the funnel-like surface.

Transition body 208 has a receptacle portion 211 which receives bin 206. Bin 206 includes a tubular portion 212 with a mounting ring 214 formed integral with the tubular portion. The interior of the tubular portion 212 is a right circular cylinder which terminates at the upper portion of the funnel-like transition interior surface 208.

Sleeve 207 is slidably mounted on tube 202. Sleeve 207 is made of plastic material as is sleeve 108 but may be made of any suitable material. Each flask 200 is mounted in its respective aperture 48 of the filling machine, as described above for the flasks 12. Sleeve 207 operates in the same manner as each of the sleeves 108 described in detail above.

The operation of measuring flask 200 is identical to the operation of measuring flask 12 except for the fact that divided matter is delivered into bin 206 as well as transition body 204, tube 202 and sleeve 216, thus providing a greater amount of divided matter to be introduced into its container 220 though the tube may be narrow. It has been found that the utilization of the specific construction for the funnel-like transition interior surface 208 allows material having poor flowability to flow through the measuring flask without the material holding up in the flask.

Although a specific embodiment of the herein disclosed invention has been shown in the accompanying drawings and described in detail above, it is readily apparent that those skilled in the art may make various modifications and changes in the disclosed invention without departing from the spirit and scope thereof. It is to be expressly understood that the instant invention is limited only by the appended claims.

I claim:

1. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, said surface of revolution is generated by a line including an arc of a circle, and said transition interior surface having a reduced portion adjacent to the tube aligned with the upper end of the cylindrical interior surface and the remainder of the transition interior surface extending outward and upward from the reduced portion.

2. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a plane defined adjacent to the end of the tube connected to the transition body, said surface of revolution generated by a line including an arc of a circle, and said circle having its center in said plane, and said transition interior surface having ar educed portion adjacent to the tube aligned with the upper end of the cylindrical interior surface and the remainder of the transition interior surface extending outward and upward from the reduced portion.

3. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, the surface of revolution is a portion of an elliptic hyperboloid of one sheet, and said transition interior surface having a reduced portion adjacent to the tube aligned with the upper end of the cylindrical interior surface and the remainder of the transition interior surface extending outward and upward from the reduced portion.

4. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, the surface of revolution is generated by a line including an arc of a circle and a straight line tangent to the arc of the circle, and said transition interior surface having a reduced portion adjacent to the tube aligned with the upper end of the cylindrical interior surface and the remainder of the transition interior surface extending outward and upward from the reduced portion.

5. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a bin connecting the one end of the transition body with the rotatable floor, and said transition interior surface having a reduced portion adjacent to the tube aligned with the upper end of the cylindrical interior surface and the remainder of the transition interior surface extending outward and upward from the reduced portion.

6. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a tubular bin connecting the one end of the transition body with the rotatable floor, said tubular bin having a cylindrical bin interior surface substantially parallel to the cylindrical interior surface of the tube, and said transition interior surface having a reduced portion adjacent to the tube aligned with the upper end of the cylindrical interior surface and the remainder of the transition interior surface extending outward and upward from the reduced portion.

7. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a bin connecting the one end of the transition body with the rotatable floor, said surface of revolution generated by a line including an arc of a circle, and said transition interior surface having a reduced portion adjacent to the tube aligned with the upper end of the cylindrical interior surface and the remainder of the transition interior surface extending outward and upward from the reduced portion.

8. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a tubular bin connecting the one end of the transition body with the rotatable floor, said tubular bin having a cylindrical bin interior surface substantially parallel to the cylindrical interior surface of the tube, a plane defined adjacent to the one end of the tube, the surface of revolution generated by a line including an arc of a circle, said circle having its center in the plane, and said transition interior surface having a reduced portion adjacent to the tube aligned with the upper end of the cylindrical interior surface and the remainder of the transition interior surface extending outward and upward from the reduced portion.

9. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a bin connecting the one end of the transition body with the rotatable floor, said surface of revolution being an elliptic hyperboloid of one sheet, and said transition interior surface having a reduced portion adjacent to the tube aligned with the upper end of the cylindrical interior surface and the remainder of the transition interior surface extending outward and upward from the reduced portion.

10. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a tubular bin connecting the one end of the transition body with the rotatable floor, said tubular bin having a cylindrical interior surface substantially parallel to the cylindrical bin surface of the tube, wherein the surface of the revolution is generated by a line including an arc of a circle, a plane defined adjacent to the one end of the open ended tube, said circle having its center in the plane, and said line including a straight line tangent to the arc of the circle, and said transition interior surface having a reduced portion adjacent to the tube aligned with the upper end of the cylindrical interior surface and the remainder of the transition interior surface extending outward and upward from the reduced portion.

11. In an apparatus for filling like containers with a like measured amount of divided matter including; a filling turret, said filling turret having a rotatable portion, a drive connected to said rotatable portion, said rotatable portion being rotated in a circular path by said drive, said filling turret including a filling tank, said filling tank having a rotatable floor connected to said drive, said rotatable floor rotating with said rotatable portion of the filling turret, a plurality of measuring flasks arranged in a circle concentric with the circle of rotation of said rotatable portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including a transition body having one end connected to the rotatable floor and an opposite end extending downward, an elongated open ended tube having one end connected to said opposite end of the transition body and the other end of the tube extending downward, said tube having a cylindrical interior surface, said transition body having a funnel-like transition interior surface, said transition interior surface being a surface of revolution, a tubular bin connecting the one end of the transition body with the rotatable floor, said tubular bin having a cylindrical bin interior surface substantially parallel to the cylindrical interior surface of the tube, said surface of revolution generated by a line including an arc of a circle, a plane defined adjacent to the one end of the tube, said circle having its center in the plane, said line including a straight line tangent to the arc of the circle, a sleeve telescopically mounted on the tube and being movable axially along the tube, said sleeve having one end adapted to be engageable with an interior at the bottom of a respective container while the respective measuring flask is being filled with divided matter to be delivered to the container, means connectable to the sleeve for limiting movement of the sleeve downward relative to the tube allowing free movement of the sleeve until connection of the means to the sleeve or the sleeve to the bottom of the respective container, and said transition interior surface having a reduced portion adjacent to the tube aligned with the upper end of the cylindrical interior surface and the remainder of the transition interior surface extending outward and upward from the reduced portion.

12. A measuring flask for use in an apparatus for filling like containers with like measured amount of divided material including; a transition body, an open ended tube having one end connected to the transition body, said tube having a cylindrical interior surface, said transition body having a funnel-like transition interior surface, said transition interior surface being a surface of revolution, the surface of revolution is generated by a line including an arc of a circle, and said transition interior surface having a reduced portion adjacent to the tube aligned with the end of the cylindrical interior surface adjacent to the transition body and the remainder of the transition interior surface extending outward and upward from the reduced portion.

13. A measuring flask for use in an apparatus for filling like containers with like measured amount of divided material including; a transition body, an open ended tube having one end connected to the transition body, said tube having a cylindrical interior surface, said transition body having a funnel-like transition interior surface, said transition interior surface being a surface of revolution, a plane defined adjacent to the end of the tube connected to the transition body, the surface of revolution generated by a line including an arc of a circle, and said circle having its center in the plane, and said transition interior surface having a reduced portion adjacent to the tube aligned with the end of the cylindrical interior surface adjacent to the transition body and the remainder of the transition interior surface extending outward and upward from the reduced portion.

14. A measuring flask for use in an apparatus for filling like containers with like measured amount of divided material including; a transition body, an open ended tube having one end connected to the transition body, said tube having a cylindrical interior surface, said transition body having a funnel-like transition interior surface, said transition interior surface being a surface of revolution, the funnel-like transition interior surface is an elliptic hyperboloid of one sheet, and said transition interior surface having a reduced portion adjacent to the tube aligned with the end of the cylindrical interior surface adjacent to the transition body and the remainder of the transition interior surface extending outward and upward from the reduced portion.

15. A measuring flask for use in an apparatus for filling like containers with like measured amount of divided material including; a transition body, an open ended tube having one end connected to the transition body, said tube having a cylindrical interior surface, said transition body having a funnel-like transition interior surface, said transition interior surface being a surface of revolution, the surface of revolution is generated by a line including an arc of a circle, said line including a straight line tangent to the arc, and said transition interior surface having a reduced portion adjacent to the tube aligned with the end of the cylindrical interior surface adjacent to the transition body and the remainder of the transition interior surface extending outward and upward from the reduced portion.

16. A measuring flask for use in an apparatus for filling like containers with like measured amount of divided material including; a transition body, an open ended tube having one end connected to the transition body, said tube having a cylindrical interior surface, said transition body having a funnel-like transition interior surface, said transition interior surface being a surface of revolution, a tubular bin connected to the transition body opposite to the open ended tube, said tubular bin having a cylindrical bin interior surface substantially parallel to the cylindrical interior surface of the tube, said surface of revolution generated by a line including an arc of a circle, a plane defined adjacent to the one end of the open ended tube, said circle having its center in said plane, said line including a straight line tangent to the arc, and said transition interior surface having a reduced portion adjacent to the tube aligned with the end of the cylindrical interior surface adjacent to the transition body and the remainder of the transition interior surface extending outward and upward from the reduced portion.

* * * * *

UNITED STATES PATENT AND TRADEMARK OFFICE

CERTIFICATE OF CORRECTION

PATENT NO. : 5,022,443

DATED : June 11, 1991

INVENTOR(S) : Graeme W. Warner

It is certified that error appears in the above-identified patent and that said Letters Patent is hereby corrected as shown below:

Column 2, Line 63, cancel "116" and substitute -- 16

Column 3, Line 46, cancel ":"

Column 3, line 62, cancel "valve" and substitute -- vane

In the Claims, Column 7, Line 53, cancel "ar educed" and substitute -- a reduced

Signed and Sealed this

Fifteenth Day of September, 1992

*Attest:*

DOUGLAS B. COMER

*Attesting Officer*

*Acting Commissioner of Patents and Trademarks*